United States Patent [19]

Graef

[11] Patent Number: 4,835,816

[45] Date of Patent: Jun. 6, 1989

[54] TWIST-OFF KNOB

[75] Inventor: John T. Graef, Erwinna, Pa.

[73] Assignee: Lutron Electronics Co., Inc., Coppersburg, Pa.

[21] Appl. No.: 201,502

[22] Filed: Jun. 2, 1988

[51] Int. Cl.[4] ..... E05B 1/00

[52] U.S. Cl. ..... 16/114 R; 16/121; 16/DIG. 24; 16/DIG. 30; 16/DIG. 40

[58] Field of Search ..... 16/114 R, 121, DIG. 24, 16/DIG. 19, DIG. 30, DIG. 40, DIG. 41; 74/551.9, 553, 557; 403/289, 314, 361

[56] References Cited

U.S. PATENT DOCUMENTS 3,082,642 3/1963 Hammerand ..... 74/553
3,880,536 4/1975 Petrus ..... 16/121

FOREIGN PATENT DOCUMENTS 80042 1/1963 France ..... 16/114 R

*Primary Examiner*—Nicholas P. Godici
*Assistant Examiner*—Edward A. Brown
*Attorney, Agent, or Firm*—James Riesenfeld

[57] ABSTRACT

A knob mounts on one end of a shaft whose other end guides a slidable element, such as the wiper of a slide potentiometer. The shaft has an elongated cross section, and the knob has a pair of generally parallel raised ribs on each of two facing interior sides. The ribs guide and secure the shaft into the knob. If the knob is twisted rather than slid, the knob comes off, but any deformation of the ribs and/or shaft is minimal and does not prevent the knob and shaft from being reused. The knob is particularly adapted for use with a notched, split shaft.

6 Claims, 1 Drawing Sheet

TWIST-OFF KNOB

BACKGROUND OF THE INVENTION

1. Field of the Invention

This invention relates to a knob, more particularly to a knob for a linear control that can be twisted off a shaft without damage to knob or shaft.

2. Description of the Related Art

Knobs are generally designed to fit onto shafts to facilitate turning the shafts. These shafts generally have round or "D"-shaped cross sections. Often the shaft is an element of a rotary potentiometer.

Knobs may also be used to facilitate linear motion of a shaft which may be an element of a linear slide potentiometer. In that case, the shaft generally has a rectangular cross section and moves parallel to one of the sides of the rectangle. A shaft hole in the knob is generally designed to fit snugly on the shaft. Since knobs for rotary controls are more common, a person who encounters a particular knob for the first time may be inclined to twist it. Twisting a linear-control knob will often cause damage to the knob interior, the shaft, or both.

Knobs for linear controls are available commercially from Rogan Corporation, of Northbrook, Ill., and from other manufacturers. An example of a product that incorporates a knob for linear control is the Skylark® dimmer, manufactured by Lutron Electronics Corp., of Coopersburg, PA.

SUMMARY OF THE INVENTION

In accordance with the present invention, a knob for mounting on an end of an elongated-cross-section shaft of a slidable element comprises, (a) a crown and (b) a skirt extending from said crown, at the top of said skirt, to an open bottom, said skirt having a first interior side and a second interior side generally facing said first interior side, each side having a pair of generally parallel elongated raised ribs (i) extending at least a part of the distance from said crown to said bottom of said skirt, (ii) having a separation slightly greater than the lateral dimension of said shaft, and (iii) being raised from said sides by a height that is great enough to guide said knob as it is slid onto said shaft but not so great that said ribs or shaft are substantially inelastically deformed if said knob is twisted off said shaft after being slid onto said shaft.

The knob of the present invention overcomes a shortcoming of earlier linear control knobs, which were damaged and/or caused damage to the shaft if they were twisted by mistake.

DETAILED DESCRIPTION OF THE INVENTION

Many devices are controlled by an operator moving a shaft that has a knob mounted on the end. When an electronic device is being controlled, the shaft is frequently attached to an element of a potentiometer. Thus, adjusting a knob on the face of an electronic device changes a potentiometer setting. Generally, the knob is fabricated to fit a particular style or model of shaft; when the knob is mounted on the end of the shaft, the shaft fits within a shaft hole in the knob. Rotary control knobs generally include serrations, a set screw, a spring, or some other device for assuring that the knob can be securely attached to the shaft. This additional element is needed, because when a circular shaft is in the circular shaft hole of a knob, turning the knob causes sliding at the hole-shaft interface, unless other forces are at work.

Figure 1:
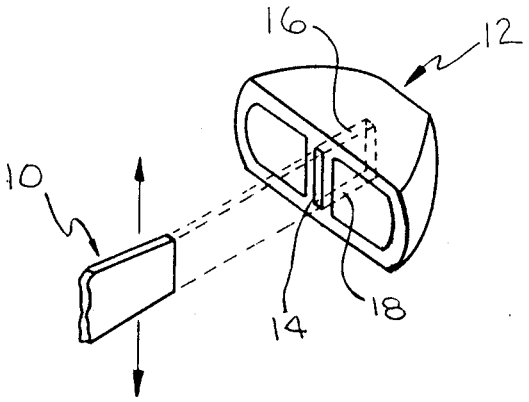
FIG. 1 PRIOR ART
FIG. 1 depicts a prior art shaft and knob.

A knob for a linear control—i.e., a control that involves a slidable element—doesn't generally require a screw or spring to secure it to the shaft. As is shown in FIG. 1, an elongated-cross-section shaft 10 is generally moved by a knob 12 that has a corresponding shaft hole 14. As used in the present specification and claims, the lateral shaft dimension is defined as being smaller than the longitudinal shaft dimension. When the knob is moved linearly, in the direction of the arrows, it imparts to an inside lateral face of the shaft hole (either 16 or 18) a force that is normal to the adjacent shaft surface. There is no tendency for slippage between the shaft hole sides and shaft.

Figure 2:
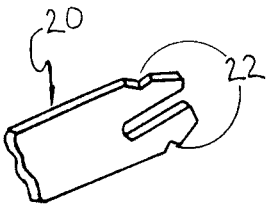
FIG. 2 PRIOR ART
FIG. 2 depicts a prior art split shaft.

While not needed to ensure that motion is imparted to the shaft, it is often desirable to secure the knob to the shaft to avoid having the knob pull off the shaft accidentally. One way in which that is accomplished is to use a split shaft that has a notch along its length. Such a shaft is shown in FIG. 2, where split shaft 20 has notch 22 to constrict its longitudinal extent. If the shaft hole of a knob has raised regions that mate with the notch, then the knob can snap into place on the shaft and be adequately secured.

A person who first encounters the knob of FIG. 1 may not realize that it operates a linear, as opposed to rotary control, and may turn it. As a result, the walls of shaft hole 14, shaft 10, or both are likely to be deformed. The knob, shaft (and possibly the control to which the shaft is attached), or both must then be replaced. In order to overcome this problem, the knob of the present invention provides a "twist-off" capability; i.e., it can be twisted off the shaft without substantial damage to either knob or shaft. If the knob is accidentally twisted off the shaft, it can simply be replaced on the shaft.

Figure 3:
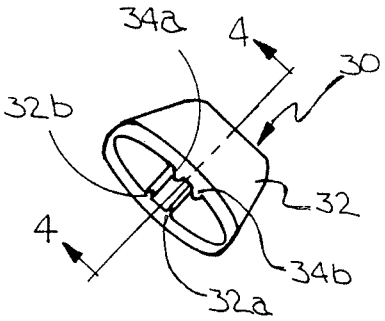
FIG. 3 depicts a knob of the present invention.

FIG. 3 shows an embodiment of the knob of the present invention. In lieu of the shaft hole 14 of the prior art knob of FIG. 1, the present knob 30 has two pairs of parallel raised ribs, 32*a* and 32*b*, 34*a* and 34*b*. These ribs guide the end of the shaft, which preferably has a rectangular cross section, as the knob is slid on. If the shaft onto which knob 30 fits is solid (i.e., not split), like shaft 10, then the material and wall thickness of knob skirt 32 must be selected to permit a substantially elastic expansion of the shaft opening. That permits the shaft to clear the ribs without deforming either the ribs or the shaft to an extent that the knob or shaft cannot be reused. Preferably, the shaft is a split shaft, like shaft 20 in FIG. 2. In that case, both shaft and knob skirt deform substantially elastically to facilitate nondestructive twist-off.

As shown in FIG. 3, skirt 32 of knob 30 is tapered to conform to a tapered shaft; however, non-tapered shafts and knob skirts may also be used. A tapered skirt is preferred, because it facilitates guiding the knob onto a shaft. Furthermore, it is easier to mold a tapered knob. When a tapered skirt is used, the ribs may be of uniform height—preferably less than about 1 mm—or may be of a tapered height to provide a constant separation between the tops of facing ribs on opposite sides of the knob skirt.

Figure 4:
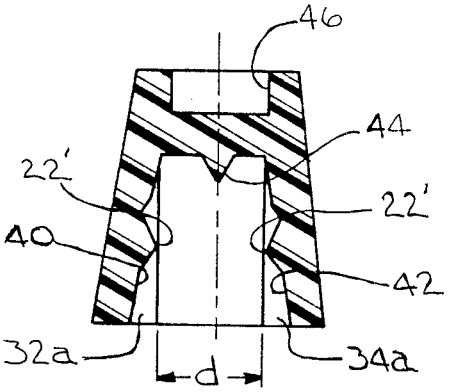
FIG. 4 is a cross section through the knob of FIG. 3.

For a notched split shaft, like shaft 20 in FIG. 2, a shaft hole that mirrors the shaft contours is preferred. FIG. 4 shows a cross section through line 4—4 of FIG. 3. Opposite interior sides 40 and 42 of skirt 32 have raised regions 22' to snap into notches 22 on shaft 20 when the knob is slid onto the shaft. Ribs 32*a* and 34*a* are tapered to provide constant separation "d" between their tops. Optional key 44 keeps the split elements separated, urging them into contact with the skirt sides. Crown 46 may simply have a flat top, or the more aesthetically pleasing shape shown in FIG. 4.

The shaft and knob may independently be formed of metal, plastic, or other materials well known in the art. A plastic knob is preferred, because it can have a desirable combination of strength and flexibility, while at the same time being inexpensive. Molding is a preferred method for fabricating knobs of this invention.

Since certain changes may be made in the knob described above, without departing from the scope of the inventions involved, we intend that all matter contained in the description or shown in the accompanying drawings be interpreted in an illustrative and not in a limiting sense.

I claim:

1. A knob for mounting on an end of an elongated-cross-section shaft of a slidable element comprising (a) a crown and (b) a skirt extending from said crown, at the top of said skirt, to an open bottom, said skirt having a first interior side and a second interior side generally facing said first interior side, each side having a pair of generally parallel elongated raised ribs (i) extending at least a part of the distance from said crown to said bottom of said skirt, (ii) having a separation slightly greater than the lateral dimension of said shaft, and (iii) being raised from said sides by a height that is great enough to guide said knob as it is slid onto said shaft but not so great that said ribs or shaft are substantially inelastically deformed if said knob is twisted off said shaft after being slid onto said shaft.

2. The assembly of claim 1 in which said sides of said knob are tapered to increase the separation of said sides at greater distances from said crown.

3. The assembly of claim 1 in which said rib height is less than about 1 mm.

4. The assembly of claim 1 in which said shaft is split and has, at a certain point along its length, a notch that constricts its longitudinal extent and said first and second interior sides of said knob have facing raised regions that snap into said notch when said knob is slid onto said shaft.

5. The assembly of claim 1 in which said knob is fabricated from a plastic material.

6. The assembly of claim 5 in which said knob is of molded plastic.

* * * * *